US005266428A

United States Patent [19]

Russell

[11] Patent Number: 5,266,428

[45] Date of Patent: Nov. 30, 1993

[54] METHOD FOR FABRICATING AN ELECTRICALLY CONDUCTIVE ARTICLE OF MANUFACTURE

[75] Inventor: Robert D. Russell, Pittsford, N.Y.

[73] Assignee: Xerox Corporation, Stamford, Conn.

[21] Appl. No.: 871,143

[22] Filed: Apr. 20, 1992

[51] Int. Cl.[5] ..... G03G 13/00

[52] U.S. Cl. ..... 430/31; 355/245

[58] Field of Search ..... 430/31; 355/245

[56] References Cited

U.S. PATENT DOCUMENTS

| | | | |
|---|---|---|---|
| 2,933,436 | 4/1960 | Miller et al. | 204/11 |
| 3,884,727 | 5/1975 | Jacobs | 148/6.2 |
| 4,868,075 | 9/1989 | Gilgore | 430/45 |

*Primary Examiner*—John Kight, III
*Assistant Examiner*—T. Mosley
*Attorney, Agent, or Firm*—Denis A. Robitaille

[57] ABSTRACT

A method for fabricating an electrically conductive article of manufacture, comprising printing an image corresponding to the article of manufacture onto an expungeable substrate using a conductive ink or conductive toner material and subsequently disposing of the expungeable substrate having the image thereon so that only the article of manufacture remains. The method is particularly adapted for use in producing a control grid of a corona generating device as utilized in electrostatographic printing apparatus.

10 Claims, 2 Drawing Sheets

METHOD FOR FABRICATING AN ELECTRICALLY CONDUCTIVE ARTICLE OF MANUFACTURE

This invention relates generally to a method for producing an electrically conductive article of manufacture, and more specifically, the present invention is directed toward an improved method for producing a control grid adapted for use in a scorotron-type corona generating device commonly found in an electrophotographic printing machine.

A variety of processes for producing articles of manufacture with electrically conductive properties having a substantially thin profile and which may embody particular configurations and/or include various and multiple apertures are well known in the art. Generally, such articles have been manufactured using sheet metal stamping and/or plating methods or photoetching techniques. Such well-known prior art manufacturing methods can be expensive and will inherently generate waste material when creating apertures or during removal of material as required to produce the specific configuration of the article. This waste material increases the price of the article and creates excess debris which, in turn, can produce environmental problems.

An exemplary electrically conductive article of manufacture having a substantially thin profile including a multiplicity of apertures is a control grid found in scorotron-type charging devices used in various subsystems of an electrostatographic printing machine. In electrostatographic processes such as xerography, it is necessary to apply charges to surfaces such as a photoreceptor or a copy sheet as part of the operation of the machine. For example, it is necessary to apply a uniform level of charge to the surface of the photoreceptor, which charge will subsequently be selectively dissipated or discharged by exposure to light. In xerographic processes the non-discharged portions retain their charge in the form of a latent image on the photoconductive surface corresponding to an image being reproduced. When the photoconductive surface is subsequently brought into contact with toner material, non-discharged portions will attract and retain toner. At a later time, a final support member, such as paper, transparencies, etc., may be brought into contact with the photoconductive surface, and a charge may be applied to the back side of the paper to attract the toner on the photoconductive surface to the support material. A detack arrangement may also be provided to apply a neutralizing charge to the copy sheet to aid in the removal of the copy sheet from the photoreceptor surface. A charge may also be applied to the photoconductive surface as part of the cleaning process to remove remaining toner from the photoconductive surface subsequent to transfer. With this relatively large number of charging devices within a single machine, it is a requirement that each charging device be provided as inexpensively as possible.

In commercial use, various types of charging systems including corona generating devices exist, wherein a high voltage in the range of ±5,000–8,000 volts is applied to a corona generating element which comprises, for example, a conductive wire or an array of conductive pins. The corona generating element is supported between a pair of insulating end blocks and mounted within a pair of conductive shield members forming a channel. This device is positioned closely adjacent to the surface to be charged in order to create a corona spray which imparts electrostatic charge to the surface of the photoreceptor or other substrate.

One specific device, frequently used to provide more uniform charging and to prevent overcharging, is a scorotron which comprises two or more conductive wires with a control grid having a series of parallel spaced conductive filaments with apertures therebetween on a plate-like member positioned between the corona wires and the surface to be charged. In operation, a potential having the same polarity as the corona potential but with a much lower voltage magnitude, typically on the order of several hundred volts, is applied to the control grid. The voltage applied to the control grid suppresses the electric field extending from the corona wires for markedly reducing the ion current flow to the surface to be charged.

The control grid of a scorotron is typically fabricated from a stainless steel material by processes generally requiring photoetching or chemical milling in order to produce the desired filament/aperture configuration within specific mechanical tolerances. These processes are, by their very nature, relatively expensive. Alternatively, high quality stamping processes have been found to be useful and less expense, wherein perforating and forming steps are carried out to form the article from a piece of stainless steel sheet metal. However, this process normally requires a second custom flattening step to achieve a prescribed degree of flatness necessary for the final product. Such high quality stamping processes have provided only minimal financial savings in most commercial manufacturing settings.

Various approaches have been used to manufacture electrically conductive articles such as a control grid compatible with a corona generating device having a plurality of laterally spaced filament elements, each separated by a relatively small aperture. The following disclosures may be relevant to the various aspects of the present invention:

U.S. Pat. No. 2,933,436; Patentee: Miller et al.; Issued: Apr. 19, 1960

U.S. Pat. No. 3,884,727; Patentee: Jacobs; Issued: May 20, 1975

The relevant portions of the foregoing disclosures may be briefly summarized as follows:

U.S. Pat. No. 2,933,436 discloses a method of making grid electrodes suitable for use in electron discharge devices wherein the grid wires or meshes are plated on a rigid grid frame member having an aperture and a planar front surface. A solid insert member is positioned within the aperture and a resist material is placed upon the insert member, portions thereof being subsequently removed so that desired areas free of resist material are created. The resist free areas are subsequently electroplated so that portions of metal material extend across certain desired portions of the aperture.

U.S. Pat. No. 3,884,727 discloses a method for coating a wire screen cloth by immersing the wire cloth in an abrasive and corrosive resistant material. Also disclosed is testing of the wire screen cloth on an electrically vibrating screen machine.

In accordance with one aspect of the present invention, there is provided a method for fabricating an electrically conductive article of manufacture comprising the steps of: printing an image corresponding to the article of manufacture onto an expungeable substrate, the image being formed of an electrically conductive material; curing the image onto the substrate to produce an impermeable image; and disposing of the substrate such that only the article of manufacture remains.

In accordance with another aspect of the invention, a method for fabricating an electrically conductive article of manufacture is provided, comprising the steps of: printing, onto an expungeable substrate, an image corresponding to the article of manufacture, the image being formed of conductive material; plating the image to provide an image having a pre-selected thickness; and then disposing of the substrate so that only the article of manufacture remains.

BRIEF DESCRIPTION OF DRAWINGS

These and other aspects of the present invention will become apparent from the following description in conjunction with the accompanying drawings in which.

Figure 1:
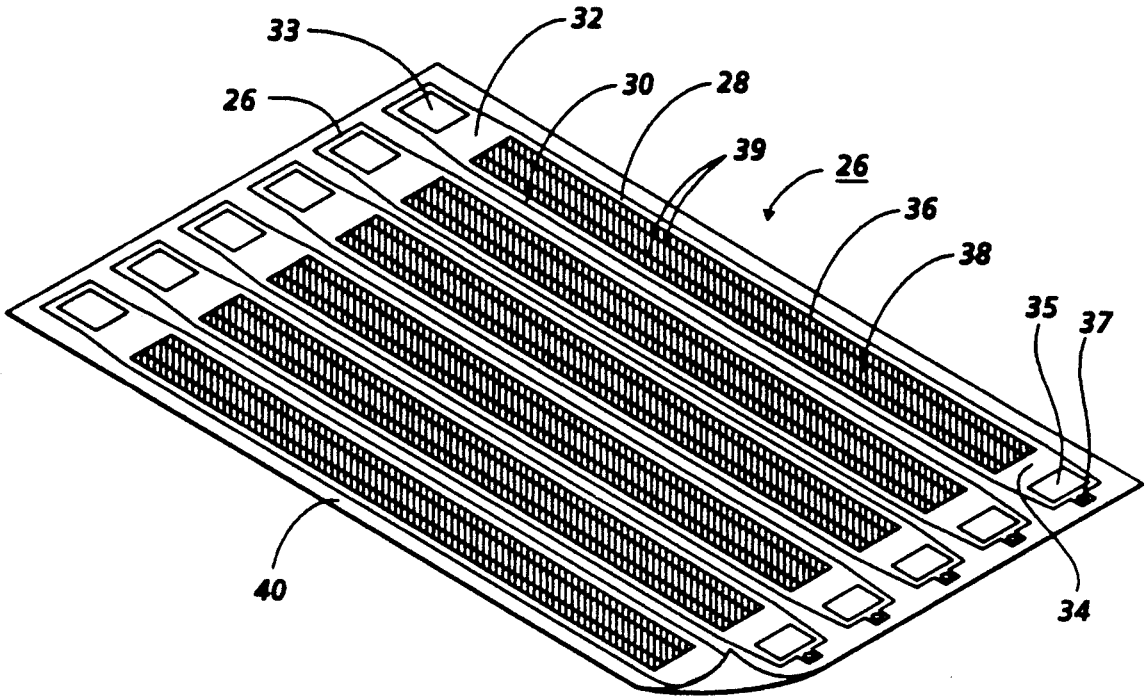
FIG. 1 is a perspective view of an image corresponding to an article of manufacture printed on an expungeable substrate in accordance with the present invention.

For a general understanding of the features of the present invention, reference is made to the drawings wherein like reference numerals have been used throughout the figures to designate corresponding elements of a preferred embodiment. While the present invention will be described in terms of a specific preferred embodiment, it will be understood that the invention is not to be limited to this preferred embodiment. On the contrary, the present invention is intended to cover all alternatives, modifications, and equivalents as may be included within the spirit and scope of the invention as defined by the appended claims.

Figure 3:
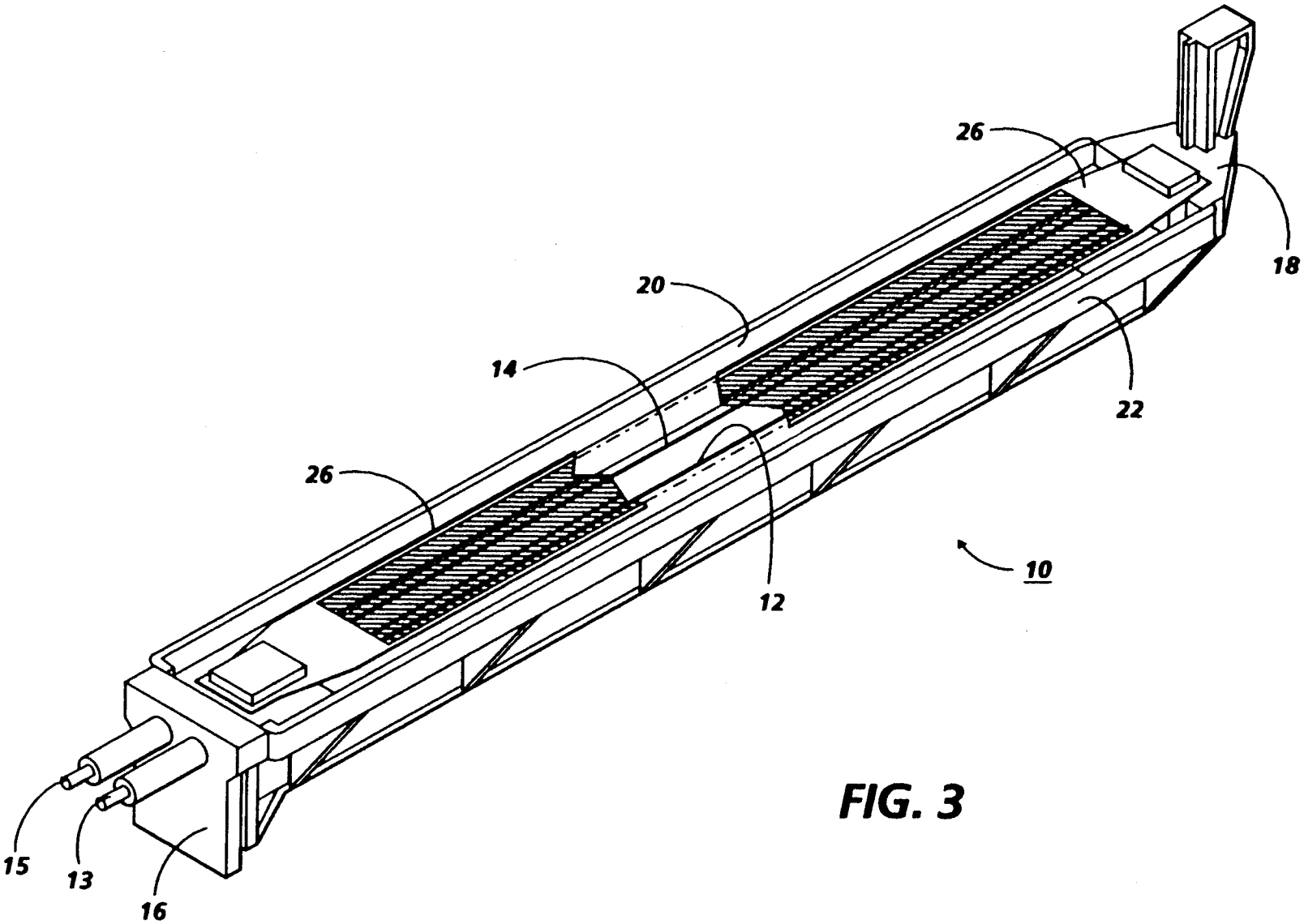
FIG. 3 is a perspective view of a typical corona generating assembly including a control grid manufactured by the method of the present invention.

Referring initially to FIG. 3 before describing the specific features of the present invention, a perspective view of the various components of an exemplary scorotron-type corona generating device including a control grid manufactured by the method of present invention is provided. Although the method of the present invention is particularly well adapted for use in producing a control grid for corona generating devices as typically used in an automatic electrophotographic reproducing machine, it will become apparent from the following discussion that the method of the present invention is equally well suited for use in producing a wide variety of articles of manufacture. The invention, therefore, is not necessarily limited in its application to the particular embodiment or embodiments shown herein. In particular, it should be noted that the method of the present invention may also be used in manufacturing various electrically conductive articles.

The exemplary scorotron assembly 10 of FIG. 3 comprises a dual wire corona discharge electrode in the form of conductive wires 12, 14 supported between insulating end blocks 16, 18. A pair of conductive side shield members 20, 22 are also supported between the insulating end blocks 16, 18 to provide structural integrity to the scorotron assembly 10 while forming a channel therebetween for increasing the ion intensity available for charging. Corona wires 12, 14 are provided with end leads 13, 15, respectively, for connection to a current source (not shown). The wires 12, 14 may be made of any conventional conductive material, such as stainless steel, gold, aluminum, copper, tungsten, platinum, or the like. A conductive corona control grid 26 is positioned across the channel formed between the side shield members 20, 22 and mounted to end blocks 16 and 18.

The scorotron assembly 10 has utility as a negative charging corona generating device wherein the potential from a high voltage DC power supply (not shown) is applied to the control grid 26 while a much higher potential is applied to the conductive electrode wires 12, 14. The control grid 26 operates to provide a reference potential for limiting or leveling the charge potential of the corona generating device. The control grid 26 may also be coated with a substantially continuous thin layer of conductive dry film such as aluminum hydroxide or other suitable coating materials. U.S. Pat. No. 4,646,196, to Reale, the relevant portions of which are incorporated by reference herein, illustrates a scorotron charging device having a control grid adapted to be positioned against the open side of such corona generating device.

Figure 2:
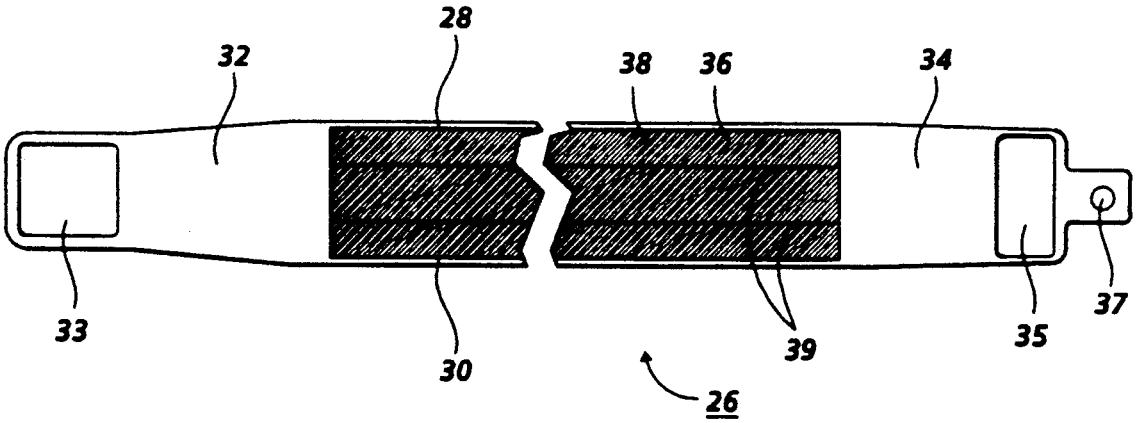
FIG. 2 shows a final product of the image of FIG. 1 as produced by the method of the present invention.

Referring now more particularly to FIGS. 1 and 2, the method of manufacturing a scorotron control grid representing a specific embodiment of an article of manufacture fabricated by the particular method of the present invention is illustrated and will be described in greater detail. Initially, as shown in FIG. 1, an image, or a plurality of images corresponding to the control grid 26 or any other suitable article of manufacture desired to be produced by the method of the present invention is printed onto a substrate 40 of expungeable material.

The image of the control grid 26 includes a peripheral border having parallel side frame members 28, 30 connected at either end to mounting tabs 36, 38. Each mounting tab 36, 38 may advantageously be provided with a mounting aperture 33, 35 and may also include a screw hole 37, as shown. The peripheral border defines an opening across which a plurality of equally spaced filament elements 36 diagonally extend. Each filament element 36 is separated by an aperture 38. A pair of support filaments 39 may also be provided, spanning the length of the opening between the mounting ends 32, 34. The opening is generally covered by a grid pattern of filament elements 36 preferably having in excess of approximately 64% open area.

The expungeable substrate 40 comprises a sheet having a surface for receiving an image of the article of manufacture. Preferably, the substrate 40 comprises soluble material, such as for example, but not limited to, a polyvinylalcohol having a thickness of approximately 0.005 inches. It will be appreciated by those of skill in the art that various other materials can be used for purposes of the present invention to provide an expungeable substrate capable of being completely obliterated so as to leave no trace thereof.

The image formed on the substrate 40 which corresponds to the article of manufacture to be fabricated comprises a conductive polymer ink, paint or toner material. This image can be produced by means of a conventional offset printing press procedure or a silk screening process utilizing an appropriate conductive ink. Likewise, electrostatographic printing techniques can be employed using a suitable conductive toner material.

After the image is printed onto the substrate, the image can be cured, if necessary, as, for example, by exposure to heat or ultraviolet light. This curing step acts to perfect the chemical bonds of the conductive ink or toner material, such that the image becomes impermeable and/or infusible. The process of printing and curing may be repeated several times to produce an image having a selected thickness. In the case of the exemplary scorotron control grid, the printing and curing steps are repeated to provide an image having a thickness of approximately 0.005 inches.

In a subsequent step, after an image of desired thickness is printed onto the substrate, the substrate 40 is disposed of by any appropriate means that incinerates, dissolves or otherwise destroys the substrate 40 while leaving the image thereon intact. For example, in the case where the substrate 40 comprises a soluble substrate, the substrate may be disposed of by exposing the substrate to a dissolving solution. This dissolving step may be implemented via any suitable means, such as by dipping the substrate in a bath of dissolving solution or by spraying the substrate with the dissolving solution. In an exemplary embodiment, a sheet of polyvinylalcohol having the image of the article of manufacture printed thereon is lowered into a tank of water such that the polyvinylalcohol substrate dissolves away while the image corresponding to the article of manufacture remains intact, thereby providing the final product, as shown, for example, in FIG. 3. The substrate 40 may also be disposed of by exposure to laser energy, radioactive energy or any other suitable means for obliterating the substrate 40 while leaving the article of manufacture intact.

As an alternative to the multiple printing and curing steps described above, the substrate 40 having the printed image thereon, may be processed via a plating process, as for example, but not limited to, by plating the image on the substrate in an electroless plating bath to increase the thickness of the image to a predetermined thickness. This plating process may also act to simultaneously dispose of the substrate or the substrate may be disposed of in a separate step, such as a dissolving step, as described above.

As a final step, after the substrate 30 has been dissolved away leaving only the article of manufacture, the article may be further processed by roller leveling to provide a final part having a specified flatness. This final part may then be further treated or processed for its intended purpose, as for example, by bending selected segments thereof or by selectively coating segments thereof.

In recapitulation, it is evident from the description herein that the manufacturing method of the present invention provides for the fabrication of an electrically conductive article of manufacture by a process of printing and curing an image comprising an electrically conductive material corresponding to the particular article of manufacture onto an expungeable substrate. The image is then built up to a desired thickness by either repeating the printing and curing step, as necessary, or by plating the image to provide an image of the article of manufacture having a selected thickness. The substrate having the image thereon is subsequently disposed of such that only the article of manufacture remains.

It is, therefore, apparent that there has been provided, in accordance with the present invention, a method of manufacture that fully satisfies the aims and advantages set forth hereinabove. While the present invention has been described in conjunction with a specific embodiment thereof, it will be evident to those skilled in the art that many alternatives, modifications and variations are possible to achieve the desired results. Accordingly, the present invention is intended to embrace such alternatives, modifications and variations which may fall within the spirit and scope of the following claims.

I claim:

1. A method for fabricating an electrically conductive article of manufacture, comprising the steps of:

printing an image of the article of manufacture on an expungeable substrate with an electrically conductive material;

curing the image to produce an impermeable image; and expunging the substrate so that only the image remains, thereby providing the article of manufacture.

2. The method of claim 1, wherein said printing step includes the step of using a silk screening process with a conductive ink to form the electrically conductive material.

3. The method of claim 1, wherein said printing step includes the step of using an electrostatographic printing process with an electrically conductive toner to form the electrically conductive material.

4. The method of claim 1, wherein said printing step includes the step of using an offset printing process, electrically conductive ink being used to form the image.

5. The method of claim 1, further comprising the steps of repeating said printing step and said curing step to provide the image with a selected thickness.

6. The method of claim 1, wherein said expunging step includes the step of exposing the substrate having the image thereon to a soluble solution.

7. The method of claim 6, wherein said exposing step dissolves a polyvinylalcohol substrate.

8. The method of claim 7, wherein said step of exposing exposes the substrate having the image thereon to water.

9. The method of claim 1, wherein said expunging step includes the step of exposing the substrate having the image thereon to an energy source for obliterating the expungeable substrate while leaving the image of the article of manufacture thereon intact.

10. The method of claim 1, wherein said step of printing prints an image of a control grid adapted for use in a corona generating device.

* * * * *